US009277822B1

(12) United States Patent
Hegedus et al.

(10) Patent No.: US 9,277,822 B1
(45) Date of Patent: Mar. 8, 2016

(54) FURNITURE MEMBER WITH POWERED MECHANISM PROVIDING LIFT AND ZERO GRAVITY POSITIONS

(71) Applicant: La-Z-Boy Incorporated, Monroe, MI (US)

(72) Inventors: Alexander M. Hegedus, Toledo, OH (US); Eric B. Harwood, Toledo, OH (US)

(73) Assignee: La-Z-Boy Incorporated, Monroe, MI (US)

( * ) Notice: Subject to any disclaimer, the term of this patent is extended or adjusted under 35 U.S.C. 154(b) by 31 days.

(21) Appl. No.: 14/475,063

(22) Filed: Sep. 2, 2014

(51) Int. Cl.

| | |
|---|---|
| ***A47C 1/00*** | (2006.01) |
| ***A47C 1/032*** | (2006.01) |
| ***A47C 1/034*** | (2006.01) |
| ***A47C 7/50*** | (2006.01) |

(52) U.S. Cl.
CPC ..... *A47C 1/03211* (2013.01); *A47C 1/0342* (2013.01); *A47C 1/03294* (2013.01); *A47C 7/506* (2013.01)

(58) Field of Classification Search
CPC ..... A47C 1/03211; A47C 1/03222; A47C 1/03233; A47C 1/034; A47C 1/035; A47C 1/0355; A47C 1/0342; A47C 1/03294; A47C 7/506
See application file for complete search history.

(56) References Cited

U.S. PATENT DOCUMENTS

| | | | | |
|---|---|---|---|---|
| 4,852,939 | A | 8/1989 | Krauska | |
| 5,288,126 | A | 2/1994 | Saul et al. | |
| 5,466,046 | A | 11/1995 | Komorowski et al. | |
| 5,651,580 | A * | 7/1997 | LaPointe | A47C 1/0355 297/325 |
| 5,730,494 | A | 3/1998 | LaPointe et al. | |
| 5,806,920 | A | 9/1998 | Blount | |
| 5,931,532 | A | 8/1999 | Kemmerer et al. | |
| 5,992,931 | A | 11/1999 | LaPointe et al. | |
| 6,000,758 | A | 12/1999 | Schaffner et al. | |
| 6,213,554 | B1 * | 4/2001 | Marcoux | A61G 5/14 297/330 |
| 6,659,556 | B2 * | 12/2003 | Pellerin | A61G 5/14 297/330 |
| 7,543,885 | B2 | 6/2009 | Pollard et al. | |
| 7,575,279 | B2 | 8/2009 | Robertson | |
| 7,631,937 | B2 | 12/2009 | Robertson | |
| 7,699,389 | B2 | 4/2010 | Robertson | |

(Continued)

OTHER PUBLICATIONS

International Search Report for PCT/US2013/056948 mailed Nov. 12, 2013.

(Continued)

*Primary Examiner* — Philip Gabler
(74) *Attorney, Agent, or Firm* — Harness, Dickey & Pierce, P.L.C.

(57) ABSTRACT

A furniture member powered mechanism providing both lift and zero gravity operating positions includes a first torque tube having first and second connecting links fixed thereto. The connecting links are each rotatably connected to a first or second connecting arm. The first and second connecting arms are rotatably connected to a gear housing. A positioning motor connected to the gear housing displaces a slide member coupled to the gear housing. Slide member motion displaces the first and second connecting arms, displacing and rotating the first torque tube. First and second connecting plates are rotatably connected to the slide member. A second torque tube is fixed at opposite ends to each of first and second arm rest portions of a furniture member base portion. The first and second connecting plates are also connected to the second torque tube such that slide member displacement rotates the base member.

23 Claims, 14 Drawing Sheets

(56) References Cited

U.S. PATENT DOCUMENTS

| | | | | |
|---|---|---|---|---|
| 7,735,912 | B2 | 6/2010 | Robertson | |
| 7,766,421 | B2 | 8/2010 | Lawson | |
| 8,398,168 | B2 * | 3/2013 | Lawson | A47C 1/0355 297/259.2 |
| 8,727,433 | B2 * | 5/2014 | Lawson | A61G 5/14 297/330 |
| 8,833,844 | B2 * | 9/2014 | LaPointe | A47C 1/0355 297/259.2 |
| 8,991,925 | B2 * | 3/2015 | LaPointe | A61G 5/14 297/325 |
| 2005/0104430 | A1 | 5/2005 | Splane | |
| 2011/0248544 | A1 | 10/2011 | Adams et al. | |
| 2011/0260513 | A1 * | 10/2011 | Chen | A47C 1/0342 297/344.11 |
| 2012/0112518 | A1 | 5/2012 | Murphy et al. | |
| 2013/0049411 | A1 | 2/2013 | LaPointe | |
| 2013/0062914 | A1 | 3/2013 | Marshall et al. | |
| 2014/0070585 | A1 * | 3/2014 | LaPointe | A61G 5/14 297/316 |
| 2015/0076883 | A1 * | 3/2015 | LaPointe | A47C 1/024 297/354.1 |
| 2015/0076891 | A1 * | 3/2015 | LaPointe | A47C 31/008 297/85 M |

OTHER PUBLICATIONS

Written Opinion of the International Searching Authority for PCT/US2013/056948 mailed Nov. 12, 2013.

International Search Report and Written Opinion of the International Searching Authority for PCT/US2015/047119 mailed Nov. 3, 2015.

* cited by examiner

FURNITURE MEMBER WITH POWERED MECHANISM PROVIDING LIFT AND ZERO GRAVITY POSITIONS

FIELD

The present disclosure relates to furniture members having powered mechanisms providing for lift and zero gravity occupant positions.

BACKGROUND

This section provides background information related to the present disclosure which is not necessarily prior art.

Furniture members such as recliners, sofas, love seats, and ottomans commonly provide a structural frame supporting a body which allows the body to displace forwardly from an upright or seated operating position to a lift position which raises an occupant of the furniture member to an elevated position approximating a standing position. The lift mechanism is powered to assist the occupant who may not be able to stand effectively from the furniture member normal upright position. Known mechanisms allowing such lift travel do not, however, also permit a rearward tilt motion of the body to a zero gravity position while still maintaining wall clearance at all seatback member positions.

SUMMARY

This section provides a general summary of the disclosure, and is not a comprehensive disclosure of its full scope or all of its features.

According to several aspects, a furniture member powered mechanism providing both lift and zero gravity operating positions includes a first torque tube. First and second connecting links are fixed to the first torque tube. The first connecting link is rotatably connected to a first connecting arm and the second connecting link is rotatably connected to a second connecting arm. A gear housing has the first and second connecting arms rotatably connected to the gear housing. A positioning motor connected to the gear housing operates to slidably displace a slide member coupled to the gear housing. Slide member motion displaces the first and second connecting arms displacing and rotating the first torque tube. First and second connecting plates are rotatably connected to the slide member. A second torque tube is fixed at opposite ends to each of first and second arm rest portions of a base portion of the furniture member. The first and second connecting plates are also connected to the second torque tube such that displacement of the slide member causes rotation of the base member.

According to other aspects, a furniture member powered mechanism providing both lift and zero gravity operating positions includes a first torque tube. First and second connecting links are fixed to the first torque tube. The first connecting link is rotatably connected to a first connecting arm and the second connecting link rotatably connected to a second connecting arm. A gear housing has the first and second connecting arms rotatably connected to the gear housing. A positioning motor is connected to the gear housing. Operation of the positioning motor slidably displaces a slide member slidably coupled to the gear housing. Sliding motion of the slide member acts to displace the first and second connecting arms, thereby displacing and rotating the first torque tube. Displacement of the first torque tube causes rotation of a base portion of the furniture member and rotation of the first torque tube, causing rotation of a seatback member coupled to the base portion. A drive motor is coupled to first and second pantograph linkage sets connected to a leg rest assembly. The first and second pantograph linkage sets and the leg rest assembly are displaced between a retracted and a fully extended position only by operation of the drive motor.

According to further aspects, a furniture member powered mechanism providing both lift and zero gravity operating positions includes a gear housing having the first and second connecting arms rotatably connected to the gear housing. A positioning motor is connected to the gear housing. Operation of the positioning motor slidably displaces a slide member slidably coupled to the gear housing. Sliding motion of the slide member acts to displace and rotate a first torque tube. First and second connecting plates are rotatably connected to the slide member. A second torque tube is fixed at opposite ends to each of first and second arm rest portions of a base portion of the furniture member. The first and second connecting plates are also connected to the second torque tube such that displacement of the slide member causes rotation of the base member with respect to a base member axis of rotation. A drive motor is coupled to first and second pantograph linkage sets connected to a leg rest assembly. The first and second pantograph linkage sets and the leg rest assembly are displaced between a retracted and a fully extended position only by operation of the drive motor.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
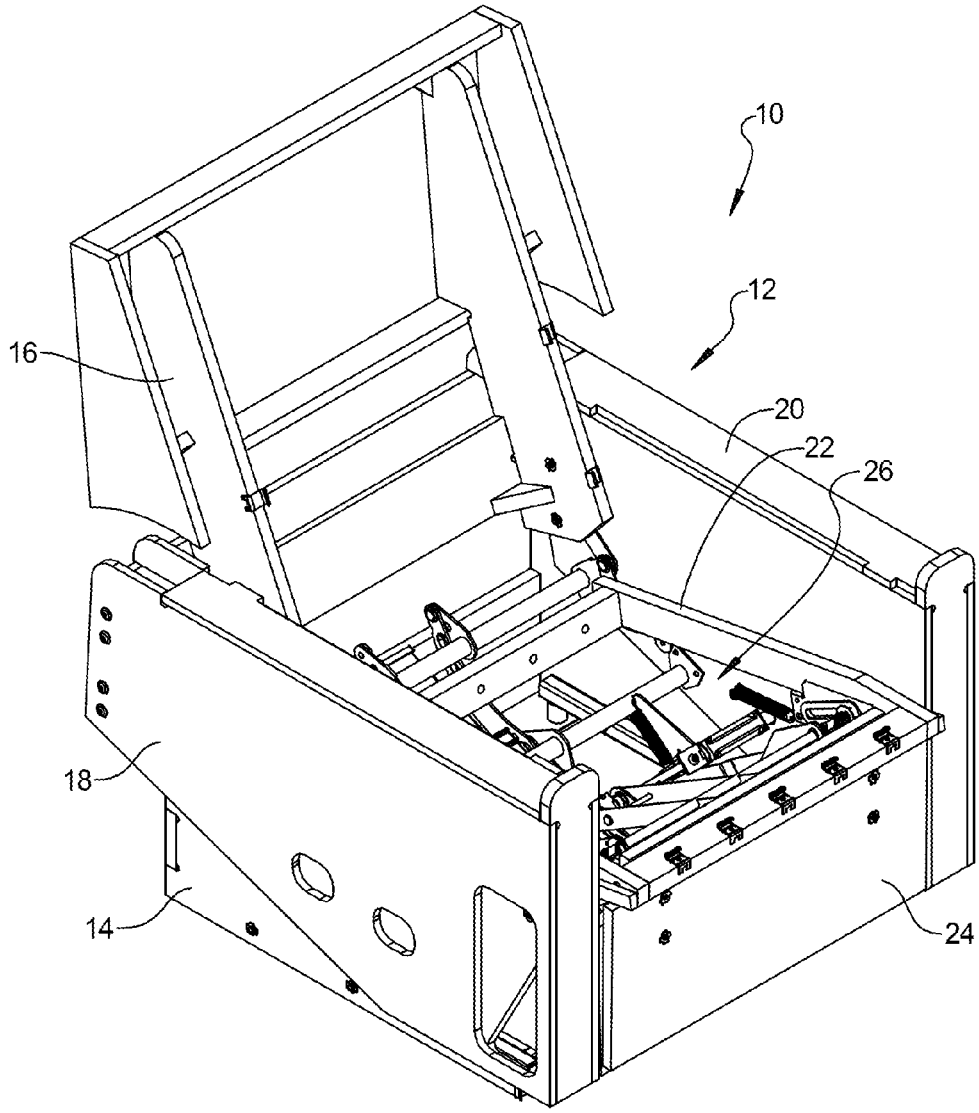
FIG. 1 is a front right perspective view of a furniture member having a powered mechanism of the present disclosure.

Referring to FIG. 1, a furniture member 10 is represented as a reclining chair; however, the furniture member 10 can also take the form of a recliner, a sofa, a loveseat, an ottoman, or similar furniture member design. Furniture member 10, in the embodiment of a reclining chair, includes a base member 12 which is supported by a support frame 14 to a surface such as a floor. A seatback member 16 is rotatably connected to the base member 12 and is shown in a fully upright position. The base member 12 includes left and right side components including a first arm rest portion 18 and a second arm rest portion 20 positioned to the right or left of an occupant of the furniture member 10.

The occupant weight is supported on a seat support frame 22 which is rotatably and displaceably connected to the seatback member 16 such that rotation of the seatback member also causes displacement of the seat support frame 22. A leg rest assembly 24 is positioned forward and below with respect to the seat support frame 22. The leg rest assembly 24 is similar to common leg rest assemblies known in the art. A mechanism 26 is positioned between the first and second arm rest portions 18, 20 and provides for powered displacement of the base member 12, the seatback member 16, and the leg rest assembly 24.

Figure 2:
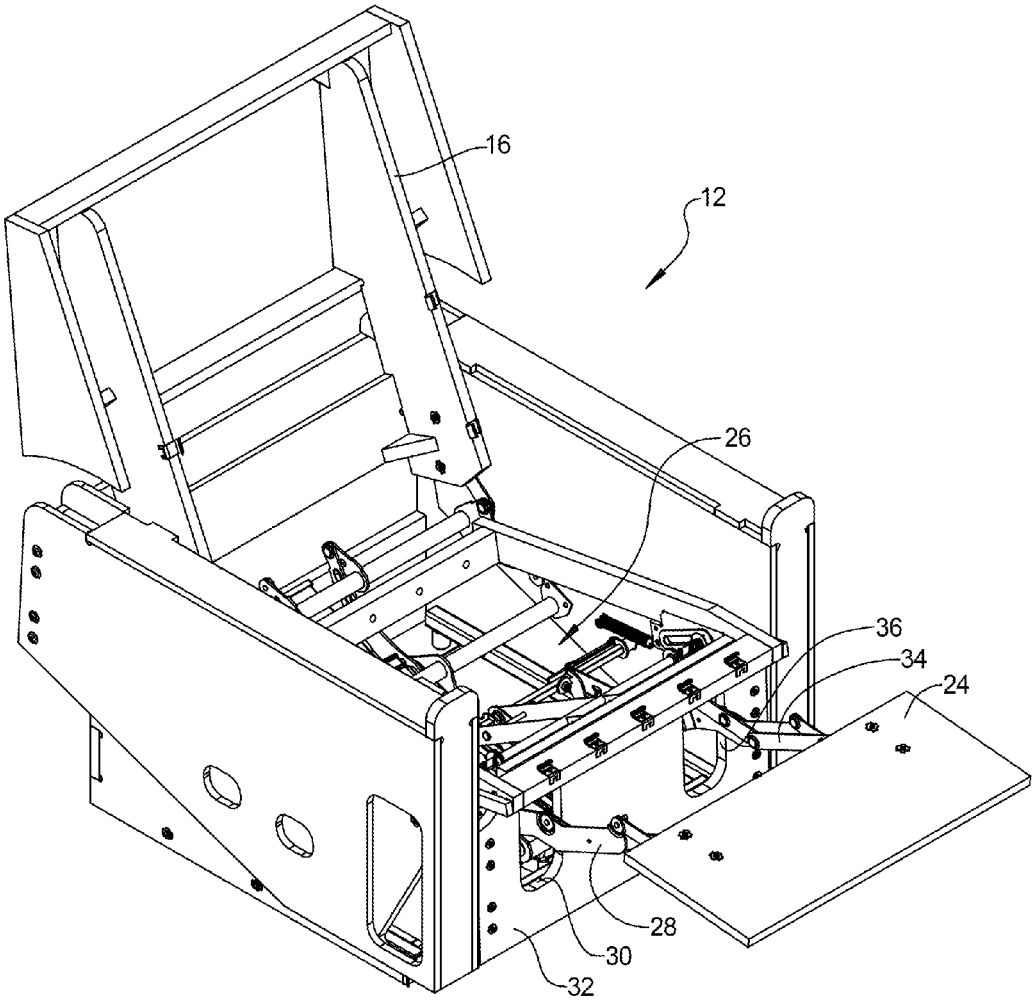
FIG. 2 is a front right perspective view of the furniture member of FIG. 1 at a leg rest extended position.

Referring to FIG. 2, the leg rest assembly 24 is shown in a fully extended position and includes a first pantograph linkage set 28 which extends through a first panel aperture 30 of a leg rest abutment panel 32. The leg rest abutment panel 32 is fixed to the first and second arm rest portions 18, 20 and can be directly contacted by the leg rest assembly in the leg rest assembly fully retracted position (shown) with respect to FIG. 1. A second pantograph linkage set 34 extends through a second panel aperture 36 of the leg rest abutment panel 32 and together with the first pantograph linkage set 28 is connected to and displaced by operation of mechanism 26.

Referring to FIG. 3 and again to FIG. 1, furniture member 10 is shown in the upright position, which includes seatback member 16 rotated to a fully forward or upright position. In addition, first and second adjustable feet 38, 40 are connected to undersides of the support frame 14 on both sides of the furniture member 10. First and second adjustable feet 38, 40 directly contact a floor surface 42 and provide for leveling of furniture member 10 with respect to floor surface 42. Each of the first and second arm rest portions 18, 20 (only first arm rest portion 18 is shown in this view) include a first arm rest face 44 which, in the furniture member upright position, is oriented substantially parallel with respect to floor surface 42. A second arm rest face 46, which intersects the first arm rest face 44, is oriented at an angle $\alpha$ in the furniture member upright position. According to several aspects, angle $\alpha$, at the furniture member upright position, defines an angle of approximately 20-30 degrees. The purpose for angle $\alpha$ will be evident by the further discussion with respect to FIG. 5.

Figure 3:
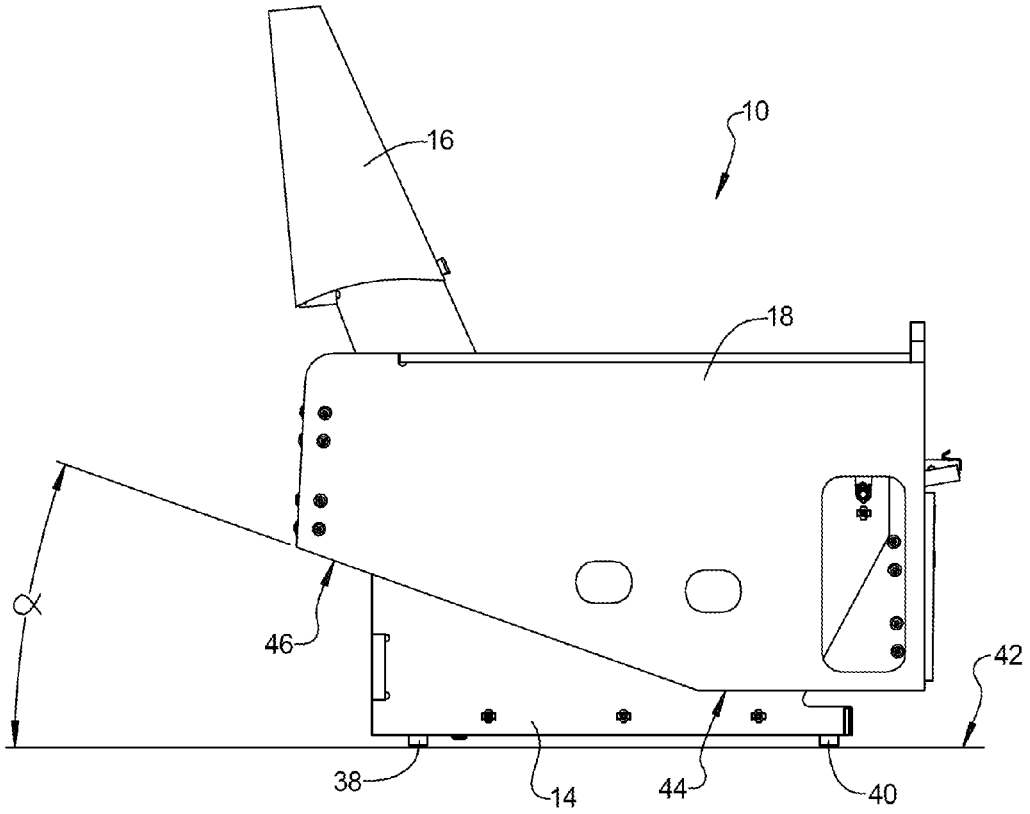
FIG. 3 is a right side elevational view of the furniture member of FIG. 1.

Referring to FIG. 4 and again to FIG. 3, the furniture member 10 is shown after a rearward rotation with respect to a base member direction of rotation "A" about a base member axis of rotation 48. The seatback member 16 is retained at its fully forward or upright position at this time. The furniture member 10 is positioned in a fully rearward rotated position wherein the second arm rest face 46 is oriented substantially parallel to the floor surface 42. The leg rest assembly 24 is shown in its fully retracted position; however, the leg rest assembly 24 can also be extended to its fully extended position with the furniture member 10 at the fully rearward rotated position, which is shown and described in reference to FIG. 5.

Figure 4:
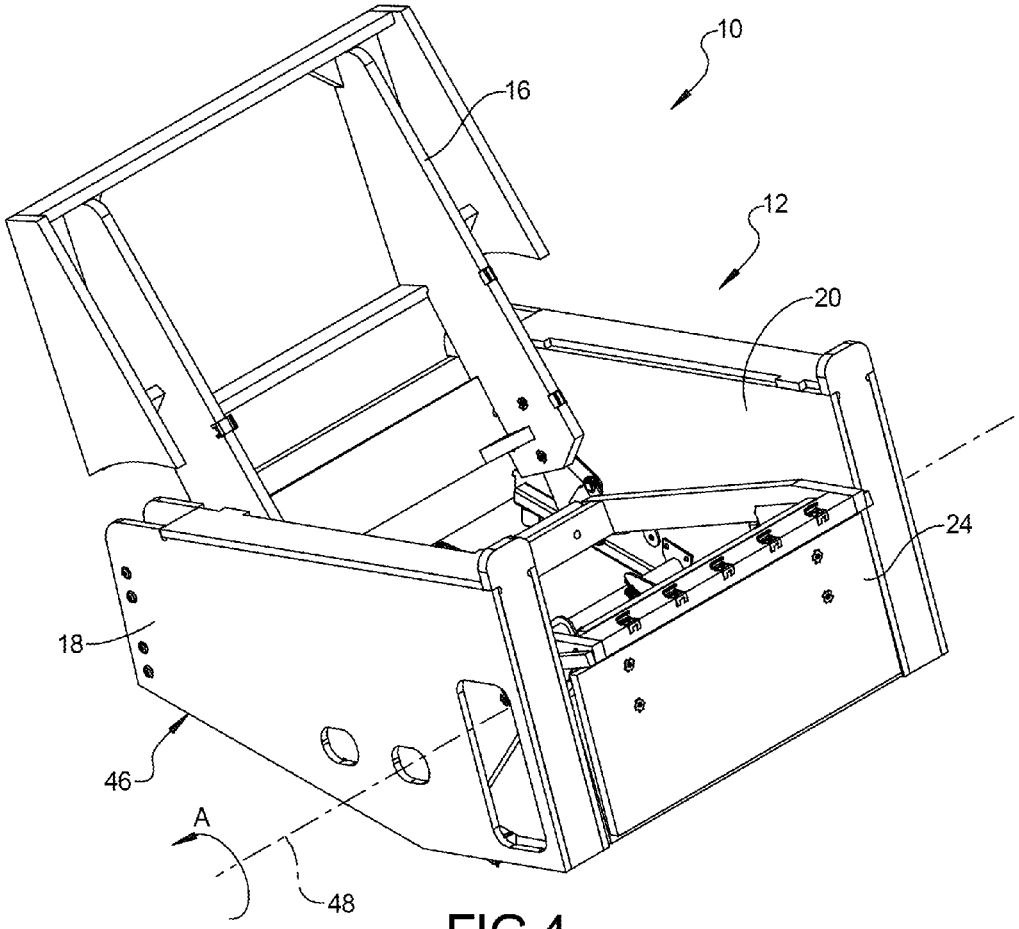
FIG. 4 is a front right perspective view of the furniture member of FIG. 1 at a zero gravity reclined position.

Referring to FIG. 5 and again to FIG. 4, with the furniture member 10 fully rotated with respect to the base member direction of rotation "A", as previously noted, the second arm rest face 46 is oriented substantially parallel with respect to floor surface 42. When the leg rest assembly 24 is subsequently extended to the fully extended position (shown), the legs of the occupant of furniture member 10 are fully supported by leg rest assembly 24.

Figure 5:
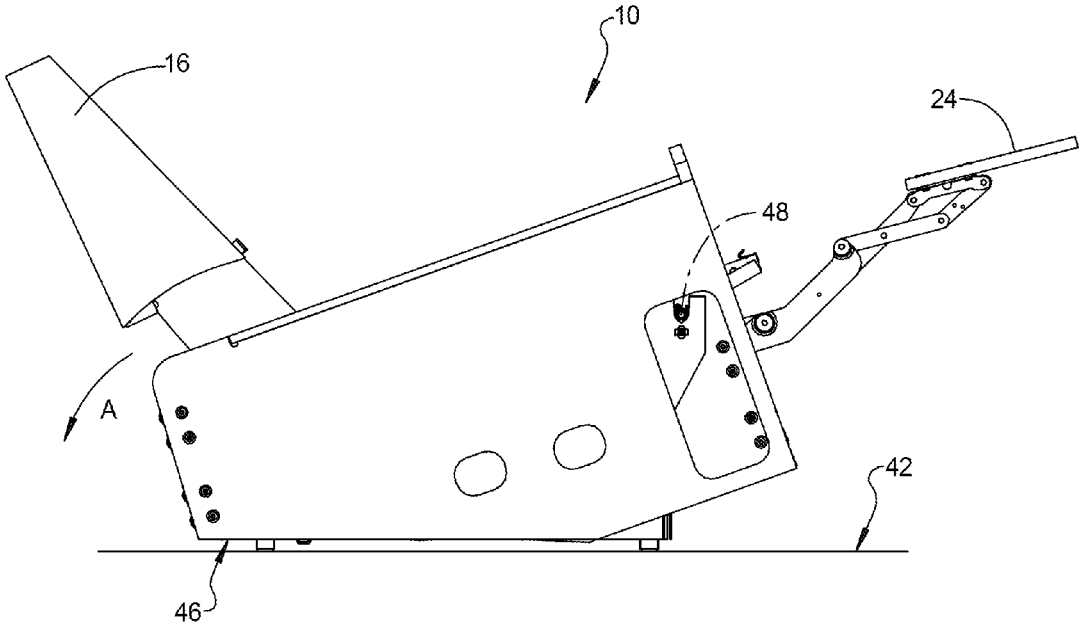
FIG. 5 is a right side elevational view of the furniture member of FIG. 4 further showing a leg rest extended position.

Referring to FIG. 6 and again to FIG. 5, with the furniture member 10 positioned in the fully rearward rotated position and the leg rest assembly 24 extended to the fully extended position, selective operation of mechanism 26 will cause the seatback member 16 to rotate with respect to base member 12 about a seatback member direction of rotation "B", which is rearward with respect to an occupant of furniture member 10. The seatback member 16 is linked to the seat support frame 22 using a first seatback member linkage set 50 and a second seatback member linkage set (not visible in this view). Due to the first seatback member linkage set 50, as the seatback member 16 rotates rearwardly, the seat support frame 22 is displaced forwardly. A zero gravity position for furniture member 10 is defined when the seatback member 16 is positioned in a fully reclined position (shown) by rotation about the seatback member direction of rotation "B", the base member 12 is positioned in its fully rearward rotated position by rotation with respect to the base member direction of rotation "A", and when the leg rest assembly 24 is in its fully extended position. The zero gravity position provides an elevation of the occupant's heart substantially level with or below the elevation of the leg rest assembly 24 at the fully extended position.

Referring to FIG. 7 and again to FIGS. 1-6, when the leg rest assembly 24 is positioned in its fully retracted position, furniture member 10 also provides for operation of mechanism 26 to rotatably displace the base member 12 in a forward arc of rotation "C" with respect to base member axis of rotation 48. During rotation in the forward arc of rotation "C", the base member 12 rotates until the first arm rest face 44 reaches an angle $\beta$ defining a chair lift position angle between first arm rest face 44 and the floor surface 42. According to several aspects, angle $\beta$ is approximately 30-40 degrees. The lift position of furniture member 10 provides for easy egress for the occupant to stand and move away from furniture member 10. As with the other operating conditions and positions for furniture member 10, mechanism 26 provides for powered displacement of base member 12 to reach the lift position shown.

Referring to FIG. 8 and again to FIG. 1, multiple components of mechanism 26, as well as of the base member 12, will be described as follows. The base member 12 can be constructed using metal tubing which includes a first frame tube 52 oriented substantially parallel to a second frame tube 54. The first and second frame tubes 52, 54 are each oriented parallel with respect to the first and second arm rest portions 18, 20. A rear cross tube 56 is fixedly connected between the first and second frame tubes 52, 54 and is positioned substantially at a rear facing portion of support frame 14. Similarly, but oppositely positioned, a front cross tube 58 is fixedly connected between the first and second frame tubes 52, 54 and is located at a forward facing end of the support frame 14. The first and second adjustable feet 38, 40 are adjustably connected at opposite ends of an underside or floor facing surface of the first frame tube 52. Similarly, first and second adjustable feet 38', 40' are adjustably connected at opposite ends of an underside or floor facing surface of the second frame tube 54.

A base side wall 60, made for example from plywood material, is fixed to the second frame tube 54. An oppositely facing base side wall is also provided with the first frame tube 52 (not visible in this view for clarity). A base rear wall 62 is fixedly connected between the base side walls and provides an opposite closure of the space surrounding mechanism 26 together with leg rest abutment panel 32. Each of the base side walls, such as base side wall 60 shown is positioned within a space defined between an inner arm rest wall 64 of second arm rest portion 20 and an outer arm rest wall 66 of second arm rest portion 20. According to several aspects, inner and outer arm rest walls 64, 66 are also provided of a wood such as plywood material. The positioning of the base side wall 60 within the space between inner and outer arm rest walls 64, 66 provides at least a portion of the base side as a barrier to the mechanism 26 even as the base member 12 rotates to the full lift position shown and described with respect to FIG. 7.

A second seatback member linkage set 68 is connected to seatback member 16 on a right hand side and is a mirror image of first seatback member linkage set 50. Each of the first and second seatback member linkage sets 50, 68 are rotatably connected to a first torque tube 70 which is oriented substantially parallel to the rear cross tube 56 and the front cross tube 58. First torque tube 70 is axially rotatable with respect to a longitudinal axis of the first torque tube 70 such that axial rotation of first torque tube 70 causes displacement of the first and second seatback member linkage sets 50, 68 which results in rotation of the seatback member 16. As previously noted, each of the first and second seatback member linkage sets 50, 68 are also connected to the seat support frame 22 such that rotation of the seatback member 16 also displaces seat support frame 22 in a generally forward or rearward direction with respect to an occupant of the furniture member 10.

For operation of the leg rest assembly 24, a DC drive motor 72 is provided which is located at a forward end of the support frame 14. Operation of the drive motor 72 causes axial rotation of a drive rod 74 with respect to a longitudinal axis of the drive rod 74. Drive rod 74 is oriented substantially parallel to the first torque tube 70. First and second support arms 76*a*, 76*b* are rotatably connected to the drive rod 74 and further connected to a support arm 76 positioned at a forward end of base member 12, and also oriented substantially parallel to first torque tube 70. The first and second pantograph linkage sets 28, 34 are both rotatably connected to each of the drive rod 74 and the support rod 78, providing support for the leg rest assembly 24 in either the fully stowed or the fully extended positions.

To provide for powered operation of the base member 12 to achieve the seatback member rotated positions, as well as the base member 12 lift positions, a positioning motor 80 connected to a gear housing 82 is located proximate to leg rest drive motor 72. A gear assembly such as a worm gear (not shown) within gear housing 82 is rotated by operation of positioning motor 80. A slide member 84 is slidably disposed with respect to gear housing 82 and connected to the gear assembly within gear housing 82. Rotation of the gear assembly within gear housing 82 with respect to a longitudinal axis of the gear housing 82 thereby causes either a forward or rearward displacement of the slide member 84 with respect to gear housing 82. First and second connecting plates 86*a*, 86*b* are rotatably connected to the slide member 84 and are fixed with respect to a second torque tube 88. Second torque tube 88 is also oriented substantially parallel with respect to first torque tube 70. Second torque tube 88 is fixed at opposite ends to each of the first and second arm rest portions 18, 20. The longitudinal displacement of slide member 84 with respect to gear housing 82 thereby causes rotation of the base member 12 with respect to base member axis of rotation 48 as described in reference to FIGS. 4-7, as well as rotation of the seatback member 16, as will be further described herein.

In addition to the first and second connecting plates 86*a*, 86*b*, the slide member 84 is also connected to each of a first connecting arm 90 and a second connecting arm 92 which are positioned on and rotatably connected to opposite sides of the slide member 84. The first and second connecting arms 90, 92 are each individually rotatably connected to one of a first or a second connecting link 94*a*, 94*b* which are both connected to the first torque tube 70. Linear displacement of the slide member 84 is thereby linked to the first torque tube 70, displacing first torque tube 70 and thereby providing motive force for rotation of seatback member 16.

Figure 8:
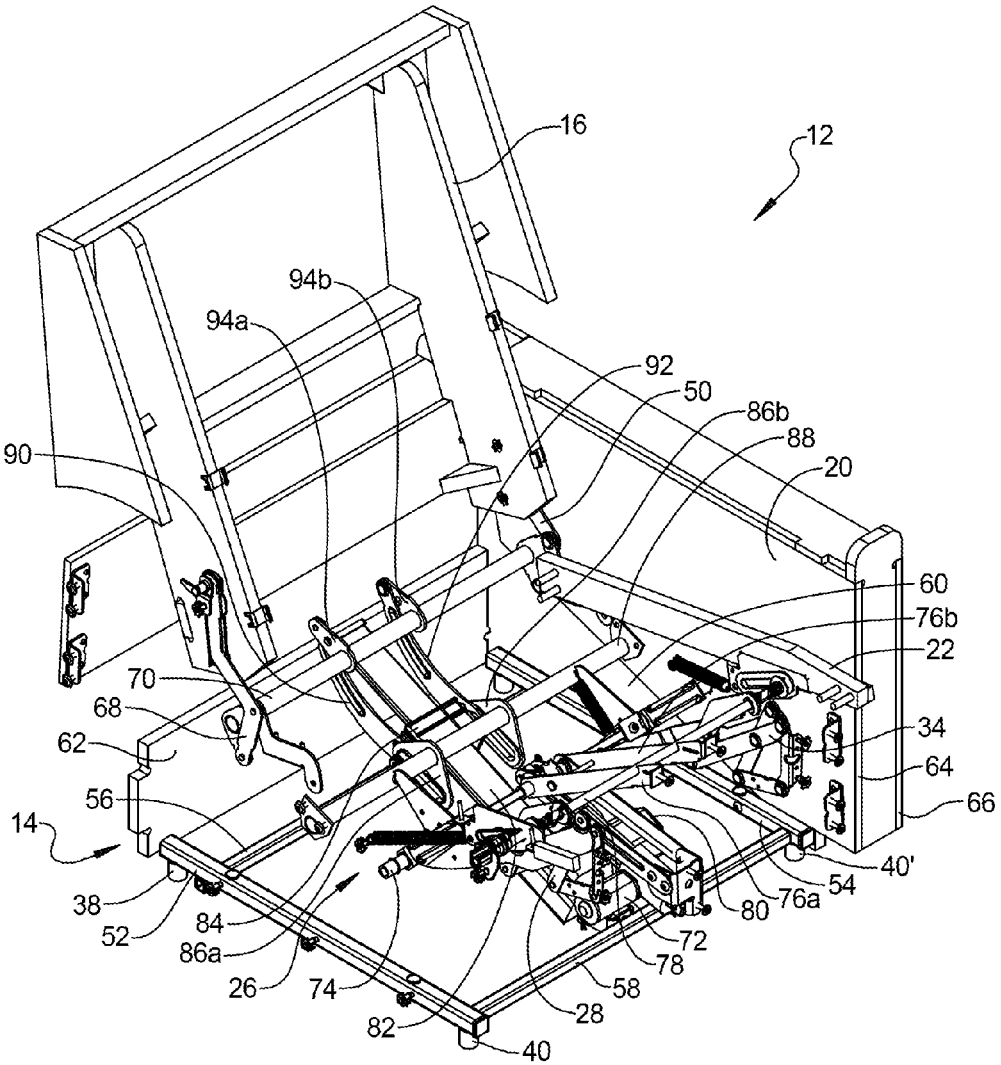
FIG. 8 is a front right perspective view of the mechanism for the furniture member of FIG. 1.

Referring to FIG. 9 and again to FIG. 8, as previously noted, the extension of the first and second pantograph linkage sets 28, 34 is accomplished by operation of drive motor 72. During displacement of the first and second pantograph linkage sets 28, 34, the support rod 78 is slidably displaced in a forward direction with respect to support rod containment members 96 connected to opposite sides of the seat support frame 22. Rotation of drive rod 74 about its central longitudinal axis, as well as forward displacement of the support rod 78, thereby provides for full extension of the link members of first and second pantograph linkage sets 28, 34. Positioning motor 80 is not operated during the extension or retraction of the leg rest assembly 24; therefore, slide member 84 displacement is not required for extension or retraction of the leg rest assembly 24. Axial rotation of the drive rod 74 also causes a forward rotation of each of a first and a second motion link 98*a*, 98*b* which are connected to the support rod 78 such that rotation of the first and second motion links 98*a*, 98*b* produces the forward displacement of support rod 78.

Figure 9:
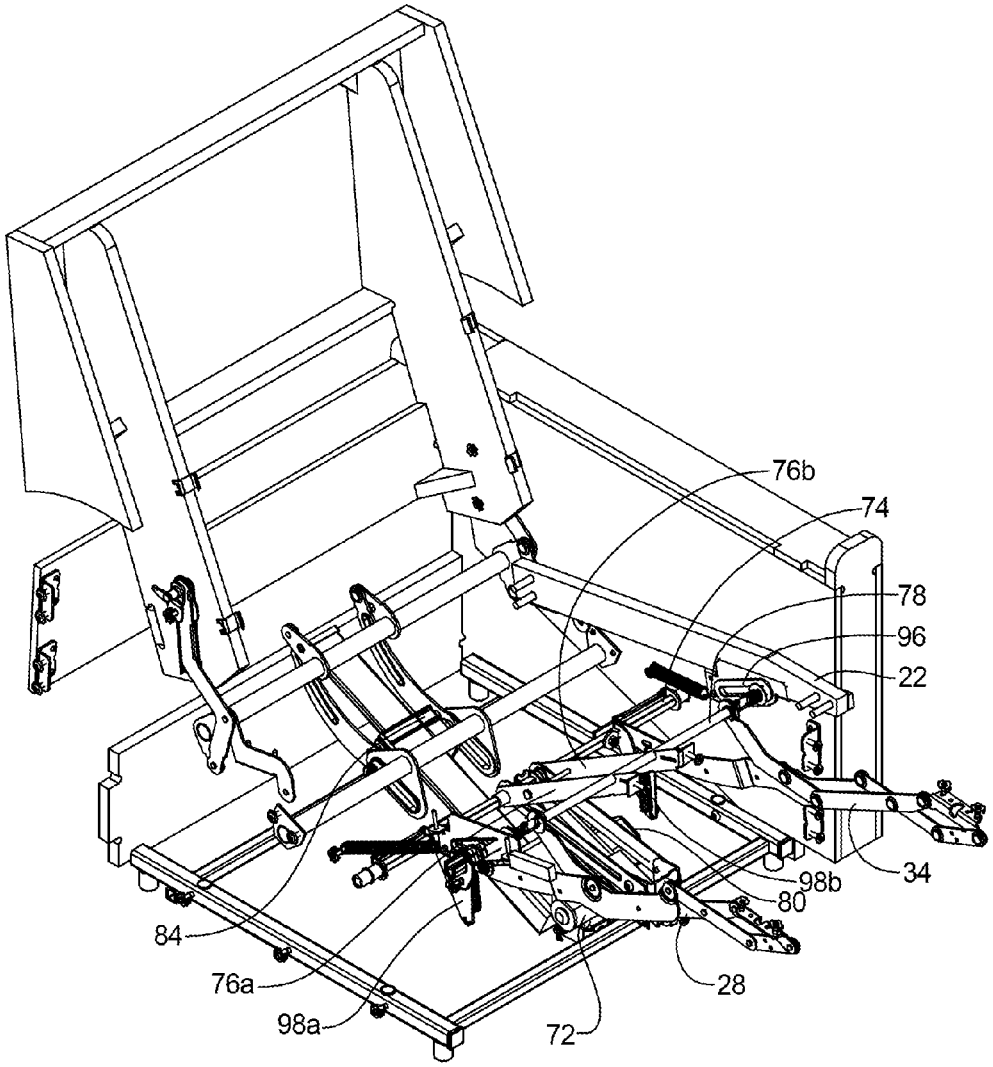
FIG. 9 is a front right perspective view of the mechanism of FIG. 8 with further members removed for clarity and the leg rest assembly in a leg rest extended position.
Figure 10:
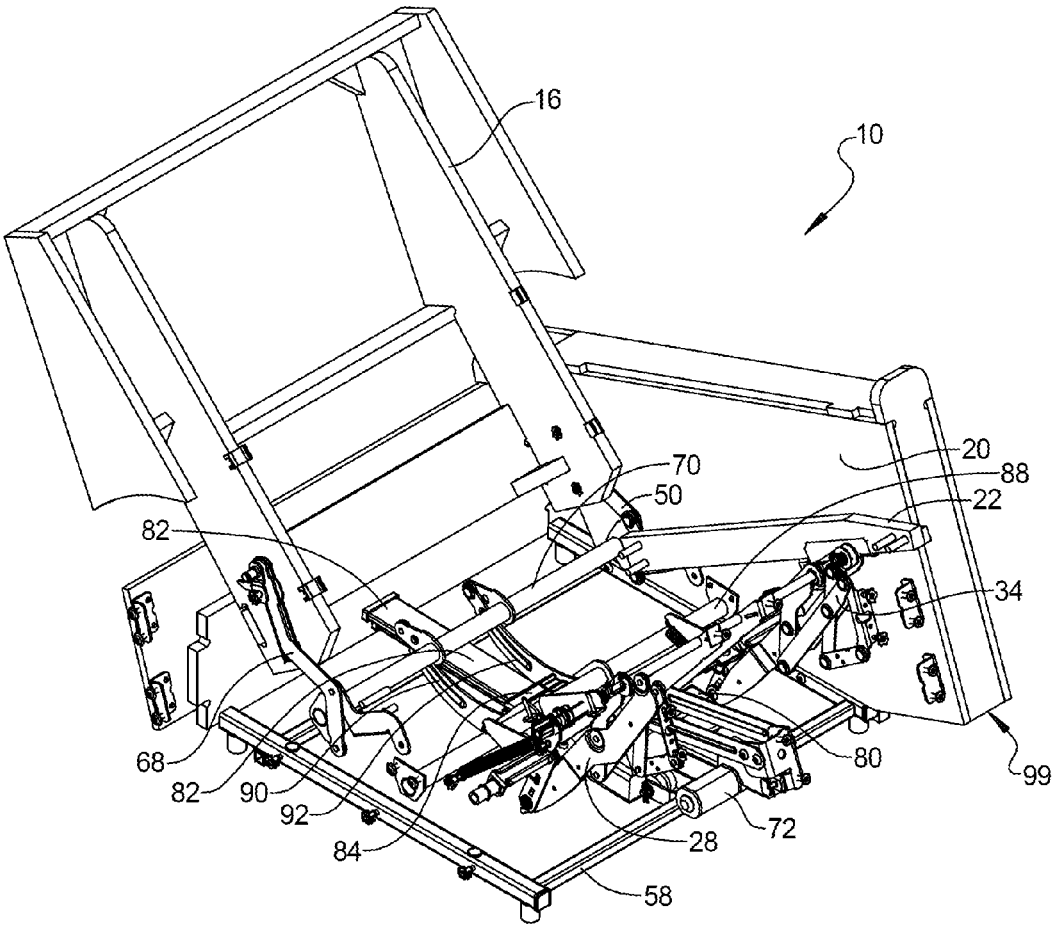
FIG. 10 is the front right perspective view of FIG. 4 with the mechanism in the zero gravity position.

Referring to FIG. 10 and again to FIGS. 1 and 8-9, to reach the seatback fully rearward rotated position shown, leg rest drive motor 72 is not operated and positioning motor 80 is electrically operated. Operation of positioning motor 80 causes a forward sliding displacement motion of slide member 84. Because the first and second connecting plates 86*a*, 86*b* are connected to both the slide member 84 and to the second torque tube 88, the forward sliding motion of slide member 84 directly forwardly displaces the second torque tube 88 and, by its connection to each of the first and second connecting arms 90, 92, the first torque tube 70 is also pulled forward. As the slide member 84 moves forward, the angle of orientation of gear housing 82 is changed such that a rear facing end of gear housing 82 rotates downwardly with respect to its nominal position shown in FIG. 8. This downward displacement of gear housing 82 causes a downward rotation at the rear end of base member 12. The forward displacement of first torque tube 70 during this operation also results in the seatback member 16 being repositioned together with the base member 12. When the furniture member 10 reaches the seat member fully rearward rotated position (shown), a forward lower corner 99 of each of the first and second arm rest portions 18, 20 (only second arm rest portion 20 is visible in this view) is both forwardly and upwardly displaced with respect to a corresponding location in the seat upright position shown in FIG. 1.

Figure 11:
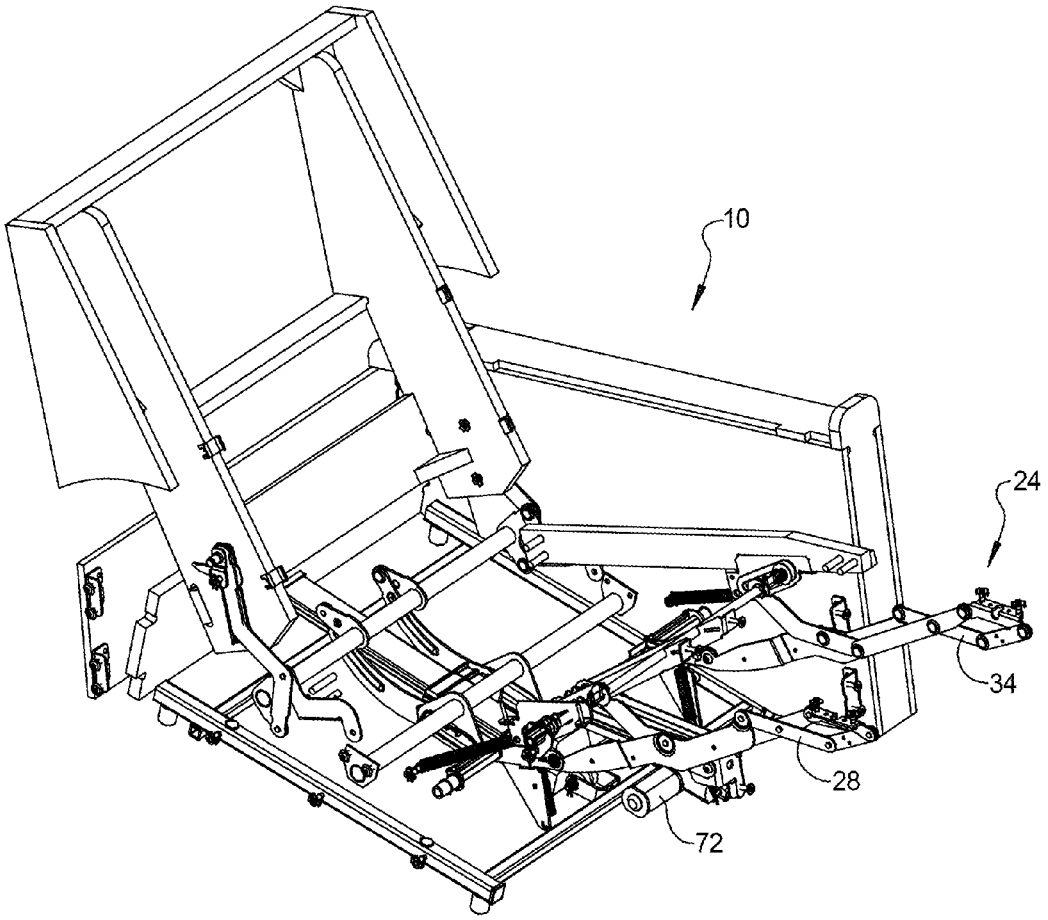
FIG. 11 is a front right perspective view modified from FIG. 10 to further showing the leg rest assembly in the leg rest extended position.

Referring to FIG. 11 and again to FIGS. 2 and 8-10, as previously noted, when the furniture member 10 is positioned in the furniture member fully rearward rotated position, the leg rest assembly 24, including each of the first and second pantograph linkage sets 28, 34, can be extended to their fully extended position by operation of drive motor 72. This operation of drive motor 72 is independent of any operation of the positioning motor 80 and therefore allows complete independent operation of leg rest assembly 24.

Referring to FIG. 12 and again to FIG. 8, slide member 84 can slide in either a forward or a rearward direction with respect to gear housing 82 by operation of positioning motor 80 in either of a forward or a rearward operational direction. In order to accommodate displacement of each of the first and second connecting arms 90, 92, these members are rotatably connected to the slide member 84 using a slide member connecting shaft 100. The axial sliding motion of slide member 84 is therefore accommodated by the rotational connection between slide member connecting shaft 100 and each of the first and second connecting arms 90, 92, which also allows for the upward and downward rotation of gear housing 82 as slide member 84 axially displaces.

Figure 12:
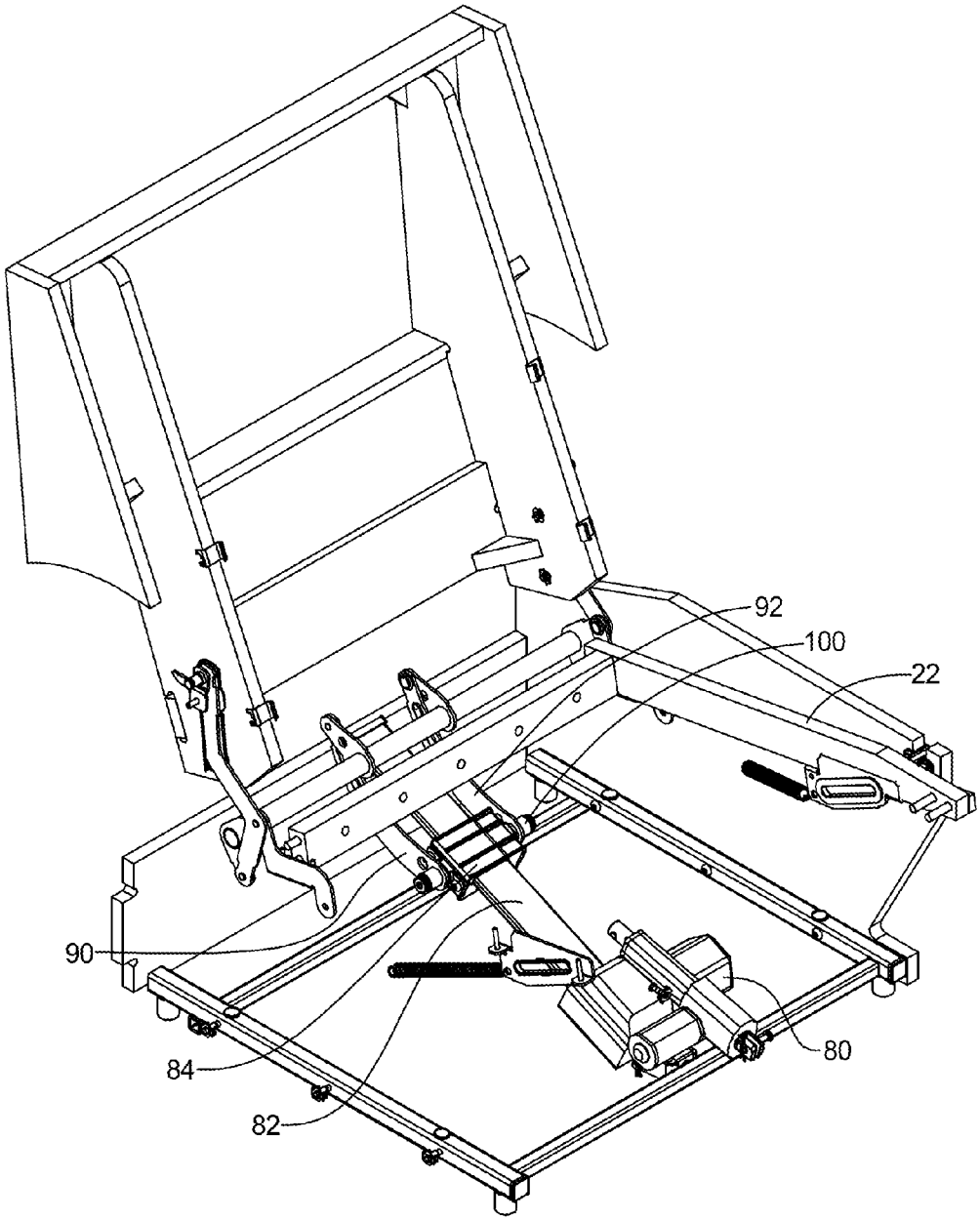
FIG. 12 is a front right perspective view of the mechanism of FIG. 8 modified to remove further components for clarity.
Figure 13:
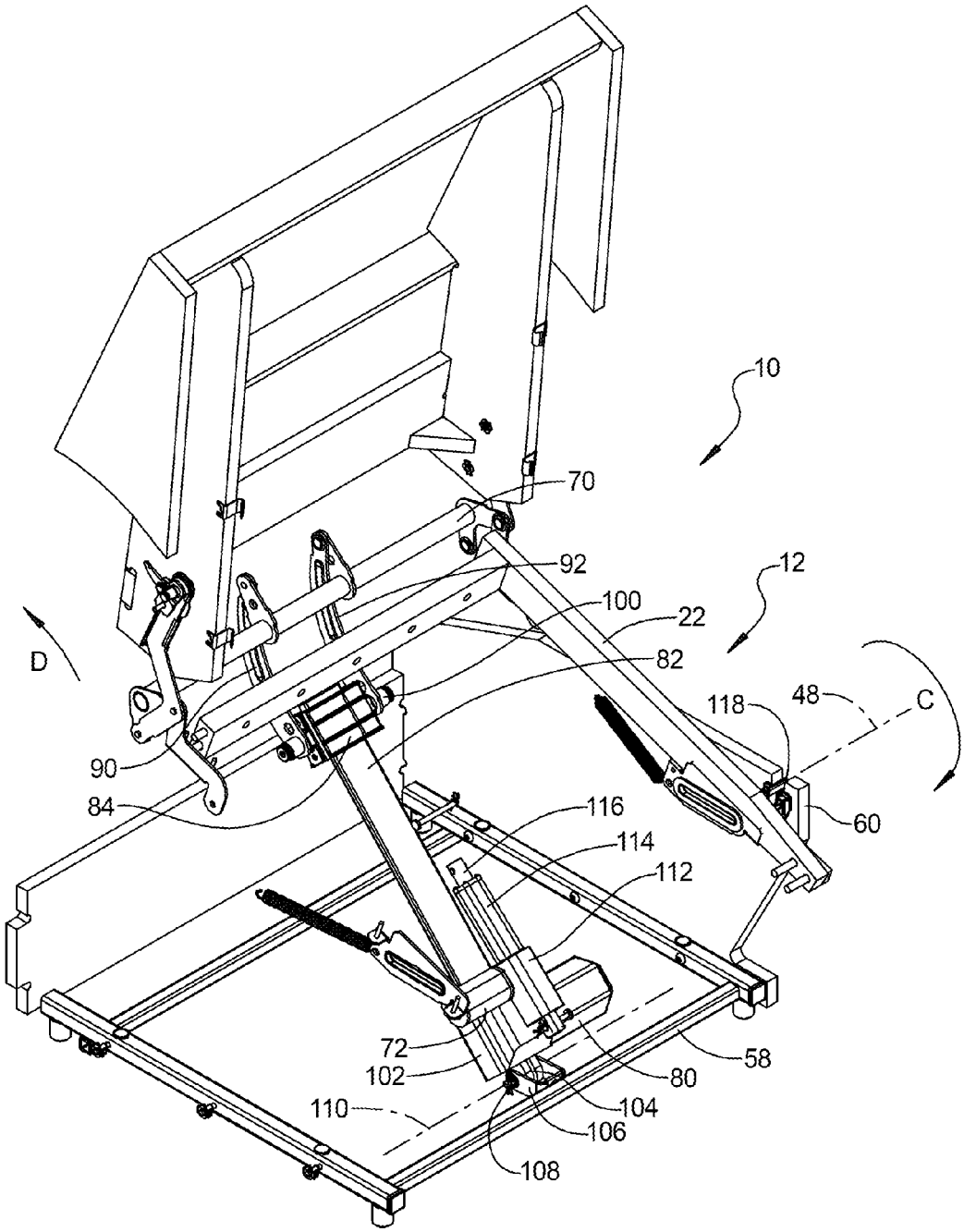
FIG. 13 is a front right perspective view of the furniture member in the lift position of FIG. 7, modified to remove components for clarity.

Referring to FIG. 13 and again to FIG. 12, to reposition the base member 12 to the full lift position shown, positioning motor 80 is operated which rotates a gear assembly (not shown) within a gear drive assembly 102, thereby axially displacing the slide member 84 on gear housing 82 in a rearward and upward displacement direction "D". The positioning motor 80 and the gear drive assembly 102 are together rotatably connected to the front cross tube 58 by a clevis 104 extending from the gear drive assembly 102 which is rotatably connected to a U-bracket 106 using a clevis pin 108. The U-bracket 106 is fixed to the front cross tube 58 such that the clevis pin 108 defines a motor axis of rotation 110. Rearward displacement of the slide member 84 and consequent rearward displacement of the first and second connecting arms 90, 92 thereby force rotation of the seat support frame 22 and the base member 12 in a forward or lift direction of rotation "C" with respect to the base member axis of rotation 48.

The drive motor 72 is connected to a drive motor gear drive assembly 112 which has internal gear assemblies (not shown) which are connected to a shaft housing 114. Operation of drive motor 72 and the gear assembly within drive motor gear drive assembly 112 cause axial extension or retraction of an axial displacement shaft 116 with respect to the shaft housing 114. The extension or retraction of axial displacement shaft 116 results in rotation of the drive rod 74 described in reference to FIG. 8. In order to provide for rotation of base member 12, a mounting pin 118 is connected to each of the sides of seat support frame 22 such that mounting pins 118 define the base member axis of rotation 48.

Figure 6:
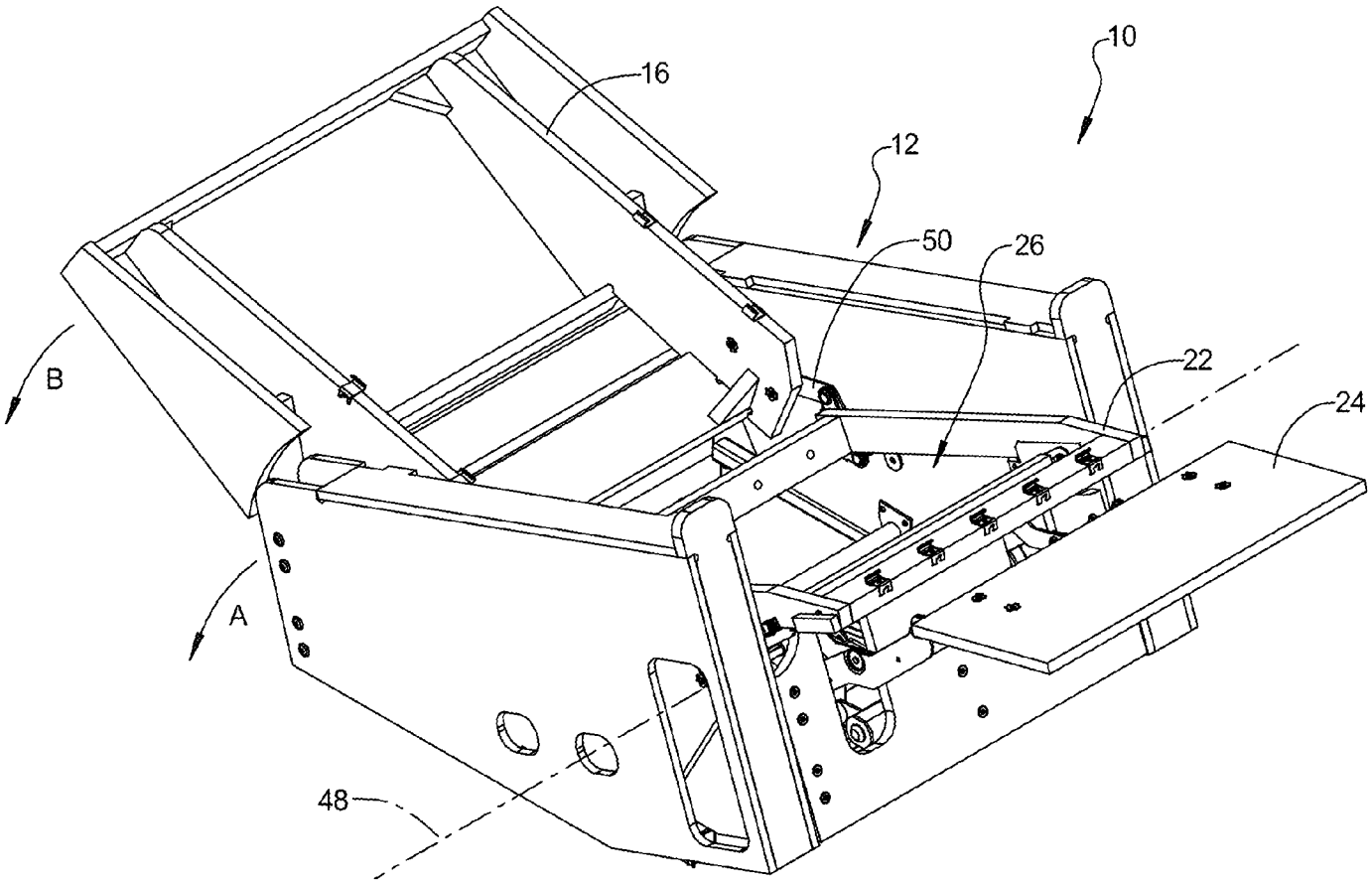
FIG. 6 is a front right perspective view of the furniture member of FIG. 5, further showing a seatback member fully reclined position.
Figure 7:
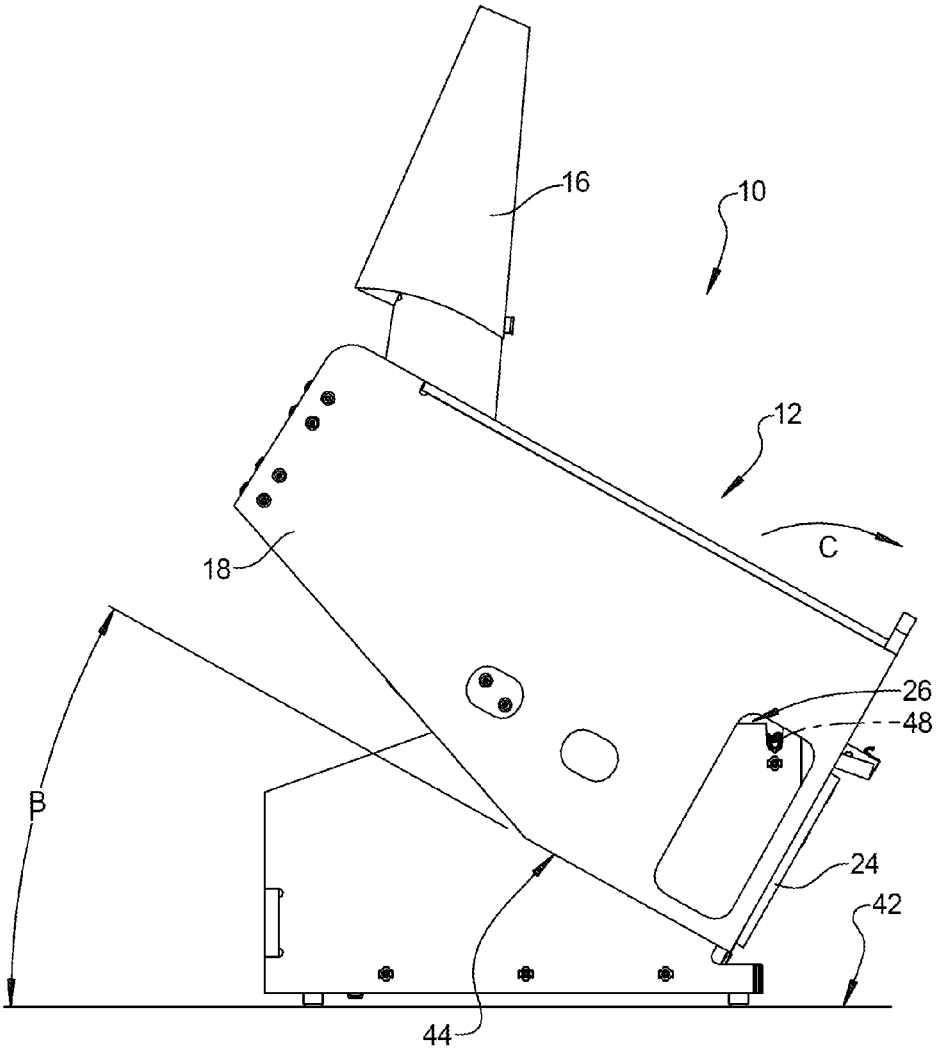
FIG. 7 is a right side elevational view of the furniture member of FIG. 1 after rotation to a full lift position.
Figure 14:
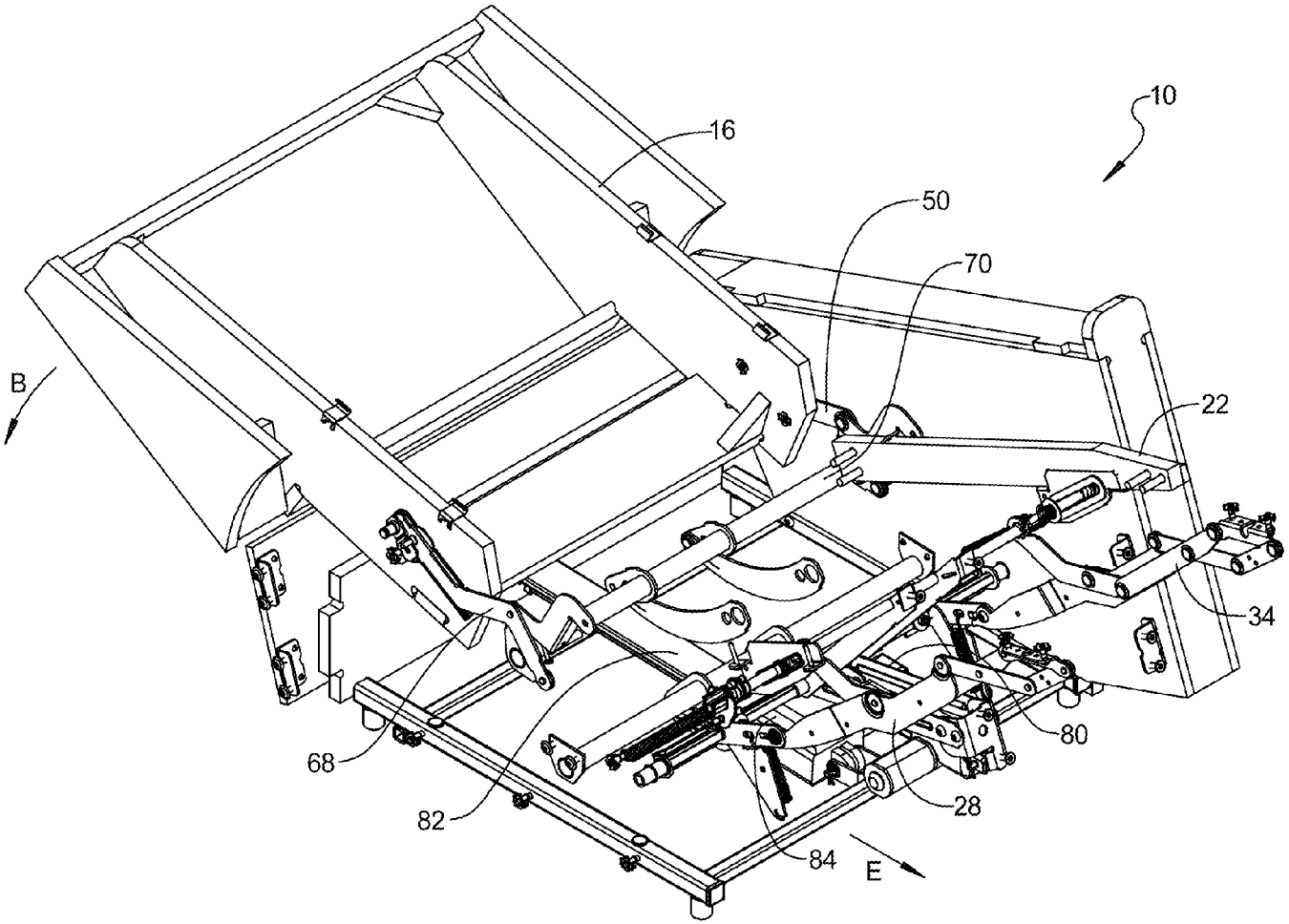
FIG. 14 is a front right perspective view of the furniture member in the seatback member fully reclined position of FIG. 6, modified to remove components for clarity.

Referring to FIG. 14 and again to FIG. 6, after the base member 12 reaches the furniture member furthest rearward rotated position shown, further operation of positioning motor 80 further slidably extends the slide member 84 in a forward direction "E" with respect to the gear housing 82. This displacement of slide member 84 causes further forward displacement of the first torque tube 70 as well as forward displacement of the seat support frame 22. As the first torque tube 70 repositions forwardly, the seatback member 16 rotates in the seatback member direction of rotation "B" to the fully reclined position due to the linked connection between the first torque tube 70 and each of the first and second seatback member linkage sets 50, 68, as previously described.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member powered mechanism providing both lift and zero gravity operating positions, comprising:

a first torque tube;

first and second connecting links fixed to the first torque tube, the first connecting link rotatably connected to a first connecting arm and the second connecting link rotatably connected to a second connecting arm;

a gear housing having the first and second connecting arms rotatably connected to the gear housing;

a positioning motor connected to the gear housing, operation of the positioning motor slidably displacing a slide member slidably coupled to the gear housing, sliding motion of the slide member acting to displace the first and second connecting arms thereby displacing and rotating the first torque tube;

first and second connecting plates rotatably connected to the slide member; and a second torque tube fixed at opposite ends to each of first and second arm rest portions of a base portion of the furniture member, the first and second connecting plates also connected to the second torque tube such that displacement of the slide member causes rotation of the base member.

2. The furniture member powered mechanism providing both lift and zero gravity operating positions of claim 1, wherein the slide member when positioned to a fully rearward position on the gear housing positions the base portion to a lift operating position having a first arm rest face of the base portion oriented at an angle ranging between 30 to 40 degrees with respect to a floor surface.

3. The furniture member powered mechanism providing both lift and zero gravity operating positions of claim 2, further including a seatback member rotatably linked to the first torque tube, wherein the slide member when positioned to a fully forward position on the gear housing forwardly moves the base portion to a zero gravity operating position having a second arm rest face of the base portion oriented substantially parallel with respect to a floor surface and the seatback member rotated fully rearward to a seatback fully reclined position.

4. The furniture member powered mechanism providing both lift and zero gravity operating positions of claim 1, further including:

a drive motor; and first and second pantograph linkage sets connected to a leg rest assembly, the first and second pantograph linkage sets displaced between a retracted and a fully extended position by operation of the drive motor;

wherein the slide member when positioned to a fully rearward position on the gear housing positions the base portion to a lift operating position.

5. The furniture member powered mechanism providing both lift and zero gravity operating positions of claim 4, wherein the drive motor is rendered inoperable during rotation of the base portion to the lift operating position such that the leg rest assembly and the first and second pantograph linkage sets are retained in the retracted position at the lift operating position.

6. The furniture member powered mechanism providing both lift and zero gravity operating positions of claim 4, further including:

a drive rod; and a support rod oriented parallel to the drive rod and slidably displaced in either a forward or a rearward direction with respect to support rod containment members connecting the drive rod to opposite sides of a seat support frame;

wherein rotation of the drive rod about a central longitudinal axis of the drive rod and forward displacement of the support rod provide full extension of the first and second pantograph linkage sets.

7. The furniture member powered mechanism providing both lift and zero gravity operating positions of claim 1, wherein the second torque tube is oriented substantially parallel with respect to the first torque tube, the first torque tube being rotatable with respect to a longitudinal axis of the first torque tube and the second torque tube being fixed and non-rotatable.

8. The furniture member powered mechanism providing both lift and zero gravity operating positions of claim 1, wherein sliding displacement of the slide member resulting from operation of the positioning motor selectively causes one of a forward displacement of the slide member causing a rearward rotation of a furniture member base member, or a rearward displacement of the slide member with respect to the gear housing causes the base member to forwardly rotate to a lift position.

9. The furniture member powered mechanism providing both lift and zero gravity operating positions of claim 1, further including seatback member linkage sets rotatably connected to and acting to rotate a seatback member, wherein the first torque tube is connected to the seatback member linkage sets such that displacement of the first torque tube rotates the seatback member.

10. A furniture member powered mechanism providing both lift and zero gravity operating positions, comprising:

a first torque tube;

first and second connecting links fixed to the first torque tube, the first connecting link rotatably connected to a first connecting arm and the second connecting link rotatably connected to a second connecting arm;

a gear housing having the first and second connecting arms rotatably connected to the gear housing;

a positioning motor connected to the gear housing, operation of the positioning motor slidably displacing a slide member slidably coupled to the gear housing, sliding motion of the slide member acting to displace the first and second connecting arms, thereby displacing and rotating the first torque tube, displacement of the first torque tube causing rotation of a base portion of the furniture member and rotation of the first torque tube causing rotation of a seatback member coupled to the base portion;

a drive motor; and first and second pantograph linkage sets connected to a leg rest assembly, the first and second pantograph linkage sets and the leg rest assembly displaced between a retracted and a fully extended position only by operation of the drive motor.

11. The furniture member powered mechanism providing both lift and zero gravity operating positions of claim 10, further including first and second connecting plates rotatably connected to the slide member.

12. The furniture member powered mechanism providing both lift and zero gravity operating positions of claim 11, further including a second torque tube fixed at opposite ends to each of first and second arm rest portions of the base portion of the furniture member, the first and second connecting plates also connected to the second torque tube such that displacement of the slide member causes rotation of the base member.

13. The furniture member powered mechanism providing both lift and zero gravity operating positions of claim 10, further including:

a tubular support frame connected to and supporting the base portion to a floor surface, the tubular support frame having first and second frame tubes;

a base side wall individually fixed to each of the first and second frame tubes, each base side wall being positioned within a space defined between an inner arm rest wall of one of a first or a second arm rest portion and an outer arm rest wall of the first or second arm rest portion.

14. The furniture member powered mechanism providing both lift and zero gravity operating positions of claim 13, further including a mounting pin connected to each of the base side walls, the mounting pins rotatably supporting the arm rest portions to the base walls and defining a base member axis of rotation.

15. The furniture member powered mechanism providing both lift and zero gravity operating positions of claim 10, wherein the slide member when positioned to a fully rearward position on the gear housing forwardly rotates the base portion with respect to the base member axis of rotation, thereby defining a lift operating position having a first arm rest face of the base portion oriented at an angle ranging between 30 to 40 degrees with respect to a floor surface and the seatback member rotated fully forward to a seatback fully upright position.

16. The furniture member powered mechanism providing both lift and zero gravity operating positions of claim 15, wherein the seatback member is rotatably linked to the first torque tube, and the slide member when positioned to a fully forward position on the gear housing rearwardly rotates the base portion with respect to the base member axis of rotation, thereby defining a zero gravity operating position having a second arm rest face of the base portion oriented substantially parallel with respect to the floor surface and the seatback member rotated fully rearward to a seatback fully reclined position.

17. The furniture member powered mechanism providing both lift and zero gravity operating positions of claim 16, wherein the positioning motor is not operated during extension or retraction of the leg rest assembly.

18. The furniture member powered mechanism providing both lift and zero gravity operating positions of claim 16, wherein the drive motor is not operated and the leg rest assembly is retained in the retracted position during operation of the positioning motor to rotate the base member to the lift operating position.

19. A furniture member powered mechanism providing both lift and zero gravity operating positions, comprising:

a gear housing having the first and second connecting arms rotatably connected to the gear housing;

a positioning motor connected to the gear housing, operation of the positioning motor slidably displacing a slide member slidably coupled to the gear housing, sliding motion of the slide member acting to displace and rotate a first torque tube;

first and second connecting plates rotatably connected to the slide member;

a second torque tube fixed at opposite ends to each of first and second arm rest portions of a base portion of the furniture member, the first and second connecting plates also connected to the second torque tube such that displacement of the slide member causes rotation of the base member with respect to a base member axis of rotation;

a drive motor; and first and second pantograph linkage sets connected to a leg rest assembly, the first and second pantograph linkage sets and the leg rest assembly displaced between a retracted and a fully extended position only by operation of the drive motor.

20. The furniture member powered mechanism providing both lift and zero gravity operating positions of claim 19, further including first and second connecting links fixed to the first torque tube.

21. The furniture member powered mechanism providing both lift and zero gravity operating positions of claim 20, further including a first connecting arm and a second connecting arm rotatably connected to the first and second connecting links and rotatably connected to the sliding member.

22. The furniture member powered mechanism providing both lift and zero gravity operating positions of claim 20, wherein when the slide member moves forward, an angle of orientation of the gear housing is changed such that a rear facing end of the gear housing rotates downwardly.

23. The furniture member powered mechanism providing both lift and zero gravity operating positions of claim 20, wherein when the slide member moves rearward, an angle of orientation of the gear housing is changed such that a rear facing end of the gear housing rotates upwardly.

* * * * *